US008001726B2

(12) United States Patent
Fassbender

(10) Patent No.: US 8,001,726 B2
(45) Date of Patent: Aug. 23, 2011

(54) FIXING SYSTEM

(75) Inventor: Frank Fassbender, Coburg (DE)

(73) Assignee: Brose Fahzeugteile GmbH & Co., KG, Coburg, Coburg (DE)

( * ) Notice: Subject to any disclaimer, the term of this patent is extended or adjusted under 35 U.S.C. 154(b) by 802 days.

(21) Appl. No.: 10/592,655

(22) PCT Filed: Mar. 3, 2005

(86) PCT No.: PCT/DE2005/000414

§ 371 (c)(1),
(2), (4) Date: Mar. 12, 2008

(87) PCT Pub. No.: WO2005/088049

PCT Pub. Date: Sep. 22, 2005

(65) Prior Publication Data

US 2008/0216407 A1 Sep. 11, 2008

(30) Foreign Application Priority Data

Mar. 12, 2004 (DE) ..... 20 2004 004 043 U

(51) Int. Cl.
*E05F 11/48* (2006.01)

(52) U.S. Cl. ..... 49/352

(58) Field of Classification Search ..... 49/374, 49/375, 348, 349, 352
See application file for complete search history.

(56) References Cited

U.S. PATENT DOCUMENTS

| | | | | |
|---|---|---|---|---|
| 4,475,314 | A | 10/1984 | Faix et al. | |
| 4,633,613 | A | 1/1987 | Kobayashi et al. | |
| 4,819,377 | A * | 4/1989 | Bauer et al. | 49/221 |
| 4,829,711 | A * | 5/1989 | Sambor | 49/211 |
| 5,058,322 | A * | 10/1991 | Sambor | 49/352 |
| 5,081,792 | A * | 1/1992 | Huebner | 49/221 |
| 5,407,289 | A | 4/1995 | Pebre | |
| 5,528,861 | A * | 6/1996 | Beyerlein | 49/352 |
| 5,729,930 | A * | 3/1998 | Schust et al. | 49/375 |
| 6,418,668 | B1 * | 7/2002 | Arquevaux | 49/352 |
| 2004/0237410 | A1 | 12/2004 | Cardine et al. | |
| 2005/0235566 | A1 | 10/2005 | Fassbender | |

FOREIGN PATENT DOCUMENTS

| | | |
|---|---|---|
| DE | 28 43 633 C2 | 4/1980 |
| DE | 33 27 295 A1 | 2/1985 |
| DE | 34 45 000 A1 | 6/1985 |
| DE | 35 31 549 C2 | 3/1987 |

(Continued)

OTHER PUBLICATIONS

English translation of International Preliminary Report on Patentability dated Sep. 18, 2007 corresponding to PCT/DE2005/000414.

(Continued)

*Primary Examiner* — Jerry Redman
(74) *Attorney, Agent, or Firm* — Christie, Parker & Hale LLP

(57) ABSTRACT

A fixing system with a fixing device for fixing a window of a motor vehicle. The fixing system comprising a slider and a displacement-force-introducing element being fitted on the fixing device. In an operating position there being an operative connection between the fixing device and the displacement-force-introducing element for the transmission of displacement forces. A reduction device used for reducing a direct transmission of force from the slider to the displacement-force-introducing element.

23 Claims, 7 Drawing Sheets

FOREIGN PATENT DOCUMENTS

| | | | | |
|---|---|---|---|---|
| DE | 102 39 447 | A1 | | 4/2003 |
| DE | 202 12 774 | U1 | | 11/2003 |
| EP | 0 568 409 | A1 | | 11/1993 |
| EP | 1 479 865 | A1 | | 11/2004 |
| JP | 06026263 | A | * | 2/1994 |

OTHER PUBLICATIONS

International Search Report, dated Dec. 14, 2005, corresponding to PCT/DE2005/000414.
European Examination Report dated Dec. 9, 2008 for Application No. 05 715 079.9, 3 sheets.

* cited by examiner

FIXING SYSTEM

CROSS-REFERENCE TO A RELATED APPLICATION

This application is a National Phase Patent Application of International Patent Application Number PCT/DE2005/000414, filed on Mar. 3, 2005, which claims priority of German Patent Application Number 20 2004 004 043.3, filed on Mar. 12, 2004.

BACKGROUND

The invention relates to a fixing system comprising a displacement-force-introducing element and a fixing means and to a window winder.

Various types of window winders have been proposed and used in practice to move a window of a motor vehicle between a closed and an open position. The opening and closing movement of the window is usually guided along a guide track or rail. Such track-controlled window winders are used in particular in the case of motor vehicles. In this case, both the guide tracks and at least parts of the window are located within a motor vehicle door or a bodywork part.

In order to be able to guide the window during its opening and closing movement along the guide rail, the window is connected either directly or via a support plate to fixing means in the form of a stepped bolt which is connected in turn to sliders which move along the guide track. Generally, a plurality of sliders, of which each runs in its own guide track, are fitted on a movable window via stepped bolts.

A window winder mechanism uses a force-introducing means, such as, for example, a cable pull, to exert a force on the window in order to bring about a movement of the window. It is known, in order to introduce a displacement force, to screw a displacement-force-introducing element, such as, for example, a cassette, together with the slider onto the stepped bolt which is fitted on the support plate of the window. The cable pull of the window winder mechanism is fitted onto the cassette. Slider put together with cassette form a driver. Depending on the type of slider, the shape of the cassette may be of very differing and complex design and have rounded portions, surfaces and corners. The force required for opening and closing the window is therefore transmitted via the cable pull to the driver, then to the stepped bolt fixed thereto, and from here via the support plate to the window.

The opening or closing movement of a window in a motor vehicle usually does not take place rectilinearly but can be configured in a manner as complex as desired. A uniform lowering of the window during opening is unfavorable if the upper edge of the window, for example, is not of rectilinear design but rather is of oblique design or if there is insufficient space in the bodywork part to receive the window, with the result that the window has to be rotated in order to be stowed. In addition, for example, curvatures of the window or of the bodywork part into which the window is moved during opening are compensated for. In order to guide the window by means of this complex rotational and sliding movement, the guide track for the slider is also of very complex design and matched precisely to the opening and closing movement. The slider or the sliders is or are guided by the guide track during the movement of the window along a movement possibly formed in all three spatial directions.

Various possibilities are known from the prior art for fixing a stepped bolt, which is fitted on the window, to a driver of this type.

DE 34 45 000 A1 describes a multipart driver, which can be plugged together, comprising a cassette for introducing a displacement force, and two slider parts. Before the driver is assembled, a connecting pin is plugged from the inside to the outside through an opening of an outer slider part and, outside the slider part, is screwed to a support of a window. In this case, a widened head of the connecting pin is located within the driver. The connecting pin is fixed by the cassette being pushed in and between the two slider parts by the connecting pin being blocked from coming out by means of the inner slider part. Cable nipples of a cable pull for introducing displacement forces are fitted into the cassette.

The complex movement and rotation of the slider mean that there is the risk of the slider tilting on a guide track. For this reason, it is known from DE 202 12 774 U1 to design the slider in multipart form as a slider assembly, between the individual slider shells of which disk springs ensure a tolerance clearance in all spatial directions, with the result that the slider can follow the guidance by the guide tracks in a sliding manner. The complex movement of the slider also moves the cassette fixed thereon, i.e. the displacement-force-introducing element, at the same time and stresses it.

SUMMARY

The invention is based on the object of providing an improved possibility of fixing a displacement-force-introducing element on a fixing means.

According to the invention, the fixing system comprises a fixing means for fixing a window of a motor vehicle, on which a slider and a displacement-force-introducing element are fitted. The fixing means is connected to the window either indirectly via a support plate or else is fitted directly on the window. In an operating position, there is an operative connection between the fixing means and the displacement-force-introducing element for the transmission of displacement forces. The fixing system has a reduction means for reducing a direct transmission of force from the slider to the displacement-force-introducing element.

The reduction means reduces the transmission of guide forces, which act on the slider, for example by means of guide tracks, to the displacement-force-introducing element. In principle, a differentiation is to be made between displacement forces, which are to be transmitted to the window via the displacement-force-introducing element, and guide forces, which guide the movement of the window and generally act essentially perpendicular with respect to the displacement forces. The slider is movable in a guided manner and serves to introduce the guide forces.

The operating position is characterized in that the fixing system is ready for use and there is an operative connection between the fixing means and the displacement-force-introducing element for the transmission of displacement forces. In contrast to the operating position, in a pre-installation position the fixing system is not yet fully installed and, as a result, is not yet functionally ready.

By reducing the transmission of force from the slider, which has movement tolerances in a plurality of spatial directions in order to be able to follow complex paths of movement, to the displacement-force-introducing element, the loading of the connection between fixing element and displacement-force-introducing element is reduced. As a result, even the stability and tolerance requirements imposed on the connection between fixing element and displacement-force-introducing element can be lowered.

In the operating position, the reduction means particularly advantageously completely prevents a direct transmission of force from the slider to the displacement-force-introducing element. As a result, a direct transmission of force from the slider to the displacement-force-introducing element is impossible and only an indirect transmission of force via the fixing means, on which both displacement-force-introducing element and slider are fitted, remains possible.

The slider and the displacement-force-introducing element can be plugged directly onto the fixing means and are designed such that they are preferably mounted rotatably about the fixing means in order to optimally adapt the forces acting on them by means of their position relative to guide rails and to one another.

In this case, it is particularly advantageous if parts of the slider are mounted on the fixing means in a manner such that they can rotate at least in two planes in order to be able to follow the complex course of the opening and closing movement of the window.

In one embodiment, in the operating position, the reduction means introduces a force acting directly from the slider in the direction of the displacement-force-introducing element into the fixing means.

For this purpose, it is advantageous if the reduction means is fitted on the fixing means and, in the operating position, is arranged between the slider and the displacement-force-introducing element. By means of the arrangement between slider and displacement-force-introducing element, the direct connecting line and therefore the direct force transmission line are interrupted.

In one embodiment, the reduction means serves as mounting for the displacement-force-introducing element and/or the slider in the operating position.

If the fixing means can be inserted along a plug-in axis into an insertion opening of the displacement-force-introducing element to produce the frictional connection, the reduction means advantageously provides a decoupling of force between slider and displacement-force-introducing element in the plug-in direction of the fixing means. This can be realized, for example, by the reduction means being arranged as a collar or clamping ring on the fixing means.

According to another aspect of the invention, the fixing system comprises a fixing means, which is fitted on a support plate for a window, and a displacement-force-introducing element, which is movable in a guided manner and has an insertion opening, into which the fixing means is insertable along a plug-in axis, and at least one latching means with which the fixing means displacement-force-introducing element is fixable in an operating position. The latching means produces, in the operating position, a latching connection between the fixing means and the displacement-force-introducing element.

By means of the latching connection between the fixing means and the displacement-force-introducing element in the operating position, tensile forces acting on the displacement-force-introducing element can be transmitted via the fixing means to the window.

In the operating position, the latching means advantageously prevents the fixing means from coming out of the insertion opening of the displacement-force-introducing element. As a result, the frictional latching connection between the fixing means and the displacement-force-introducing element continues to remain in existence.

In a particularly preferred embodiment, the latching means has a latching lug for fixing the fixing means in the displacement-force-introducing element, and the fixing means has a latching groove with a shoulder in which the latching lug engages in the operating position. By means of this engagement, the fixing means is prevented from coming out of the insertion opening of the displacement-force-introducing element by means of the shoulder stopping against the latching lug.

The latching groove is preferably of rotationally symmetrical design with respect to the plug-in axis, so that a rotational movement of the displacement-force-introducing element relative to the fixing means is also possible in the operating position. In this case, the latching connection therefore only reduces translational movements along the plug-in axis of the fixing means. The rotational movement of the two parts relative to each other permits a movement clearance which is necessary in particular if a guide track, along which the displacement-force-introducing element is guided, does not run rectilinearly. The movement of the displacement-force-introducing element along the guide rail runs smoother with said movement clearance than without it.

If the sliding means has a plurality of latching means formed concentrically with respect to the plug-in axis of the fixing means, then the latching connection is reinforced against the connection being released. The concentric arrangement of the latching means about the plug-in axis of the fixing means permits a latching connection to come about uniformly around the fixing means. If the latching connection were only to exist at one location, then the fixing means could possibly be set into an undesirably sloping position with respect to the displacement-force-introducing element. A distortion of the fixing element into such a sloping position is reduced by a uniform, concentric arrangement of the latching means.

In a further embodiment, the displacement-force-introducing element has a bearing means which supports the fixing means in the operating position such that the bearing means reduces tilting movements of the displacement-force-introducing element. In this case, tilting movements of the fixing means in relation to the displacement-force-introducing element are meant. In this case, a differentiation has to be made to the effect that the rotational movement about the plug-in axis of the fixing means does not have to be reduced in order to ensure the abovementioned movement clearance. Bearing means therefore preferably prevent tilting movements about the other two axes of rotation of the fixing means, thereby reducing the manufacturing-induced tolerance clearance between the fixing means and the displacement-force-introducing element and, as a result, reduce premature wear in particular of the insertion opening.

A bearing means of this type may comprise, for example, at least one bearing rib or a helical bearing means which bears against the fixing means in the operating position.

Furthermore, the displacement-force-introducing element can have a plurality of bearing means formed concentrically with respect to the plug-in axis of the fixing means, as a result of which the fixing means is mounted in a more uniform and balanced manner, since, by means of the multipart design of the bearing means, the friction occurring during rotational movements is distributed to a plurality of bearing means.

The displacement-force-introducing element can have both a plurality of bearing means and a plurality of latching means which are arranged concentrically and in an alternating manner around the plug-in axis of the fixing means. This ensures a balanced interplay between the bearing means and the latching means.

The displacement-force-introducing element and the latching means are advantageously composed of the same material and are designed as a single part. The two can thus be composed, for example, of plastic. The complete fixing system therefore does not require any additional parts for fixing the displacement-force-introducing element on the fixing means.

If the latching means is formed below the surface and within the insertion opening of the displacement-force-introducing element, then the latching means is located in a particularly protected position.

A fixing system according to the invention particularly preferably has both the features of the first fixing system according to the invention and of the second fixing system according to the invention. The reduction means is therefore combined with a latching connection.

By the reduction means being embodied as a collar on the fixing means, which collar has, at least in one location, a wider diameter than the insertion opening of the displacement-force-introducing element, an undesirably deep insertion of the fixing means into the displacement-force-introducing element is prevented. In this case, the collar reduces the freedom of movement along the plug-in axis in the insertion direction and helps during the fixing in the operating position.

The displacement-force-introducing element can be provided with a device for the fitting of at least one cable pull, via which device a force can be transmitted to the displacement-force-introducing element.

Furthermore, the fixing means can be of essentially cylindrical design with a cylinder axis, so that the plug-in axis coincides with the cylinder axis. In this case, the expression "essentially cylindrical" explicitly includes variations of the diameter along the cylinder axis, as occur, for example, in the case of a stepped bolt. Such a shape makes it easier to permit the desired rotational-movement clearance.

A window winder has a fixing system according to the invention, the displacement-force-introducing element together with a slider fitted on the fixing element providing a driver of the track-controlled window winder mechanism. The window winder has a guide track for controlling a displacement movement of the slider arranged on the guide track, and a force-introducing means for transmitting a force of a displacement drive of the window winder to the displacement-force-introducing element. In this case, the force-introducing means can comprise a cable pull, a Bowden cable or a dimensionally stable force transmission element.

BRIEF DESCRIPTION OF THE DRAWINGS

The invention is explained in more detail below using a plurality of exemplary embodiments and with reference to the figures of the drawings, in which.

DETAILED DESCRIPTION

Figure 6:
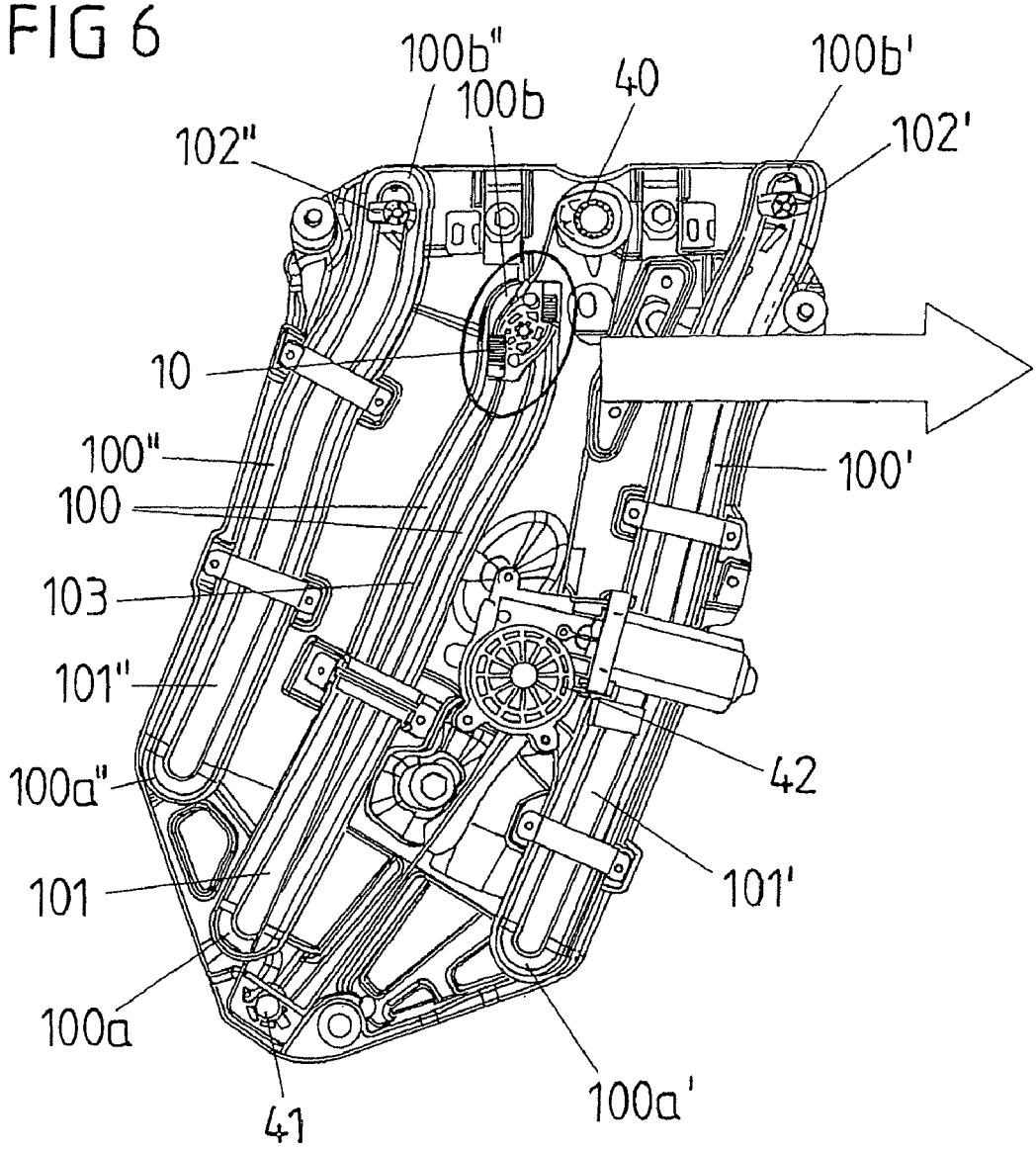
FIG. 6 shows a plan view of a driver (illustrated schematically), comprising slider and cassette placed onto it, with a surrounding window winder mechanism.

FIG. 6 shows, in a schematic illustration, an overview of a device fitted in a motor vehicle door for moving and guiding a window. Three guide rails or tracks 100, 100' and 100" serve for the track-controlled movement of a window (not illustrated). The guide rails 100, 100' and 100" are in each case of two-part design and comprise two individual rails running essentially parallel to each other, as a result of which guide-rail intermediate spaces 101, 101' and 101" are formed.

Sliders 102' and 102" are fitted in the guide-rail intermediate spaces 101' and 101" of the guide rails 100' and 100" in such a manner that they are only movable along these guide rails. A third slider in the guide-rail intermediate space 101 of the guide rail 100 is covered by a cassette 10 which is fixed on the slider which is not visible in FIG. 1A. This cassette 10 serves as displacement-force-introducing means, i.e. for introducing and transmitting the displacement forces of the window winder to the window.

All three sliders are fixed on a support plate (not illustrated) of the window and thus ensure that the guide forces are introduced, i.e. that the window can only be moved along the direction of movement predetermined by the three guide rails 100, 100' and 100". If the sliders are located at the upper guide-rail ends 100*b*, 100*b'* and 100*b"*, the window is closed, and if they are located at the lower guide-rail ends 100*a*, 100*a'* and 100*a"*, the window is open.

Two cable pulls 103 are fitted onto the cassette 10 as force-introducing means and are connected to the drive 42 via return pulleys 40 and 41. In this case, the return pulley 40 is fitted at the upper guide-rail end 100*b* while the return pulley 41 is fitted at the lower guide-rail end 100*a*. When a window-winder actuating means (not illustrated) is actuated, the drive 42 exerts a tensile force on the cable pulls 103 which transmit the tensile force to the cassette 10 and move it in the direction of one of the return pulleys 40 or 41 and therefore in the direction of one of the guide-rail ends 100*a* or 100*b*. The tensile force is transmitted via the cassette 10 to the slider (not illustrated) arranged below it and to the support plate (not illustrated) and serves for the track-controlled movement of the window.

Figure 1:
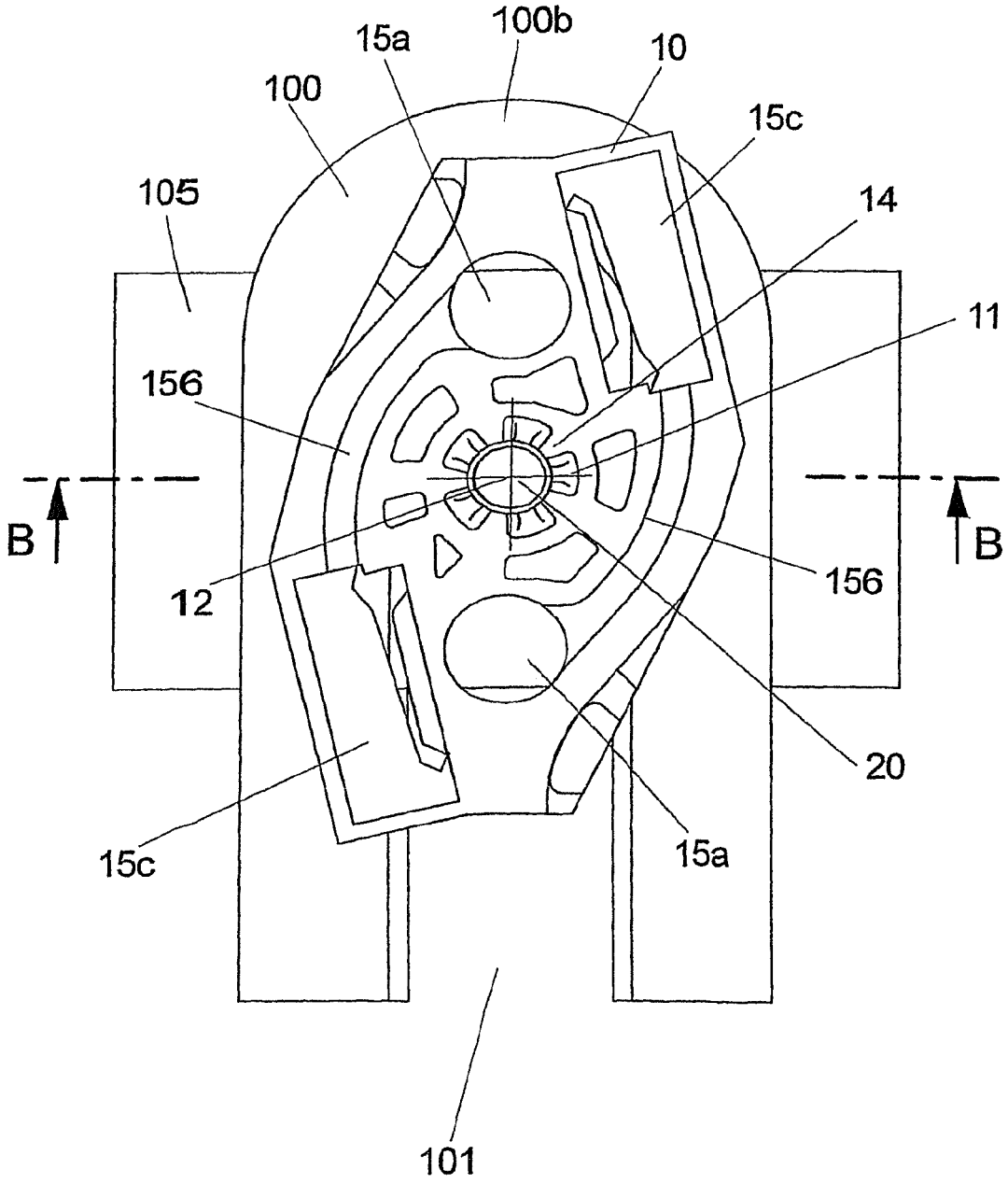
FIG. 1 shows a plan view of the fixing system according to the invention along a plug-in axis counter to the insertion direction.

In FIG. 6, an excerpt is marked which shows the cassette 10 and, apart from the cable pulls 103, is illustrated in more detail in FIG. 1.

Figure 2:
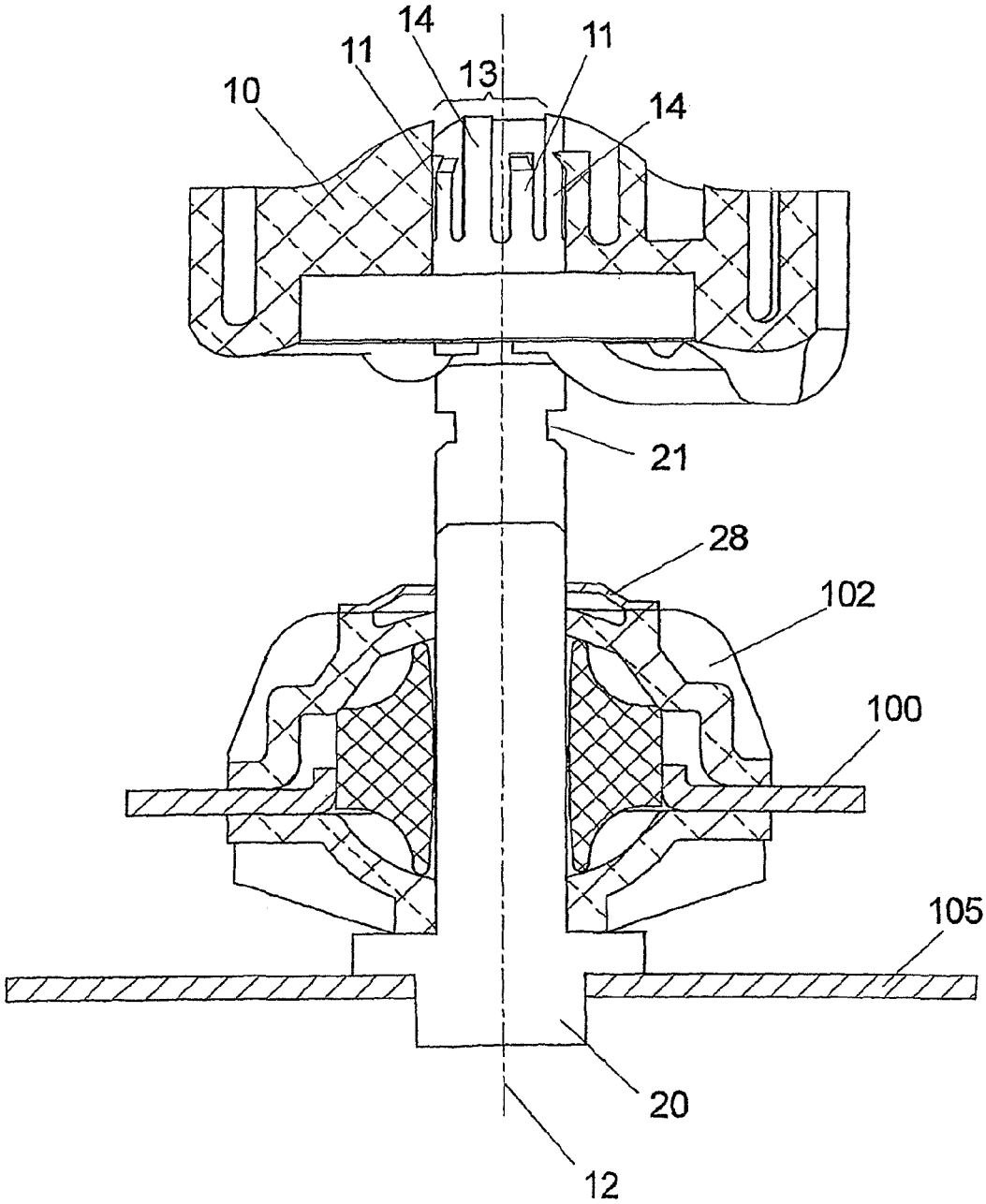
FIG. 2 shows a cross-sectional view through view lines B-B of FIG. 1 of the fixing system with a displacement-force-introducing element, a fixing means, a driver and a window in a loose formation.
Figure 3:
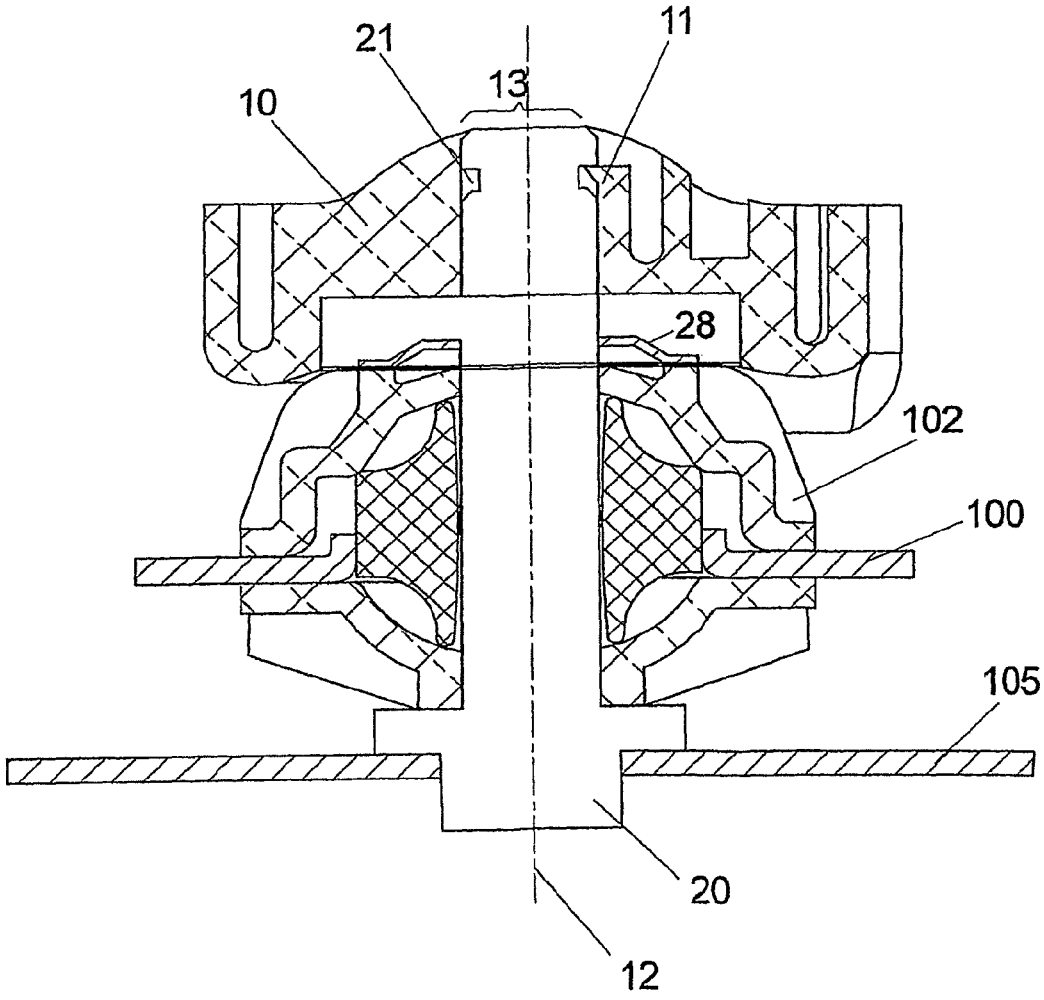
FIG. 3 shows a cross-sectional view of the fixing system according to FIG. 2 through view lines B-B of FIG. 1 with components connected to one another.

FIG. 1 shows a plan view of a fixing system which is illustrated in FIGS. 2 and 3 in a sectional illustration along the section plane indicated in FIG. 1 by the arrows B.

Before installation, a cassette 10 is present, in accordance with the sectional illustration according to FIG. 2, in the form of a cassette element with an insertion opening 13 which, in FIG. 1, points into the plane of projection and through which the section plane of FIGS. 2 and 3 runs. For installation of the fixing system, the cassette 10 is plugged onto a fixing means 20 in the form of a stepped bolt 20 by the stepped bolt 20 being inserted into the insertion opening 13. The stepped bolt 20 is screwed or riveted to a window 101. Alternatively, the stepped bolt 20 can also be screwed or riveted to a support disk which, in turn, is connected in a functional and/or form-fitting manner to the window. Furthermore, FIGS. 2 and 3 show that a slider 102 is plugged onto the stepped bolt 20 and is penetrated by the stepped bolt 20. The slider 102 bears from two sides against a guide rail 100 which is likewise penetrated by the stepped bolt 20.

FIG. 3 shows the cassette 10 which is plugged onto that end of the stepped bolt 20 which lies opposite the window, the cassette resting on the slider 102 in this position. In this case, the clamping ring 28 is located in a cut-out of the cassette 10 and does not touch the latter. It interrupts a direct flow of force from the slider assembly 102 to the cassette 10, and thereby reduces the loading and wear of the cassette 10. A weak latching mechanism can also fix the cassette 10 on the stepped bolt 20.

FIG. 1 shows, in a plan view along the arrow illustrated in FIG. 2, the cassette 10 at the end 100*b* of the guide rail 100. The guide rail 100 comprises two rails which run parallel to each other and are connected to each other at both of their ends. The free intermediate space 101 is located between the two guide rails running parallel to each other. The stepped bolt 20 runs perpendicularly to the plane defined by the two parallel guide rails through the intermediate space 101, one end of which is connected to the cutout (illustrated in the lowermost plane in FIG. 1) of the support plate 105 for a window (not illustrated). In this case, the slider 102 comprises the guide rail 100 and is itself held on the stepped bolt 20 between the cassette 10 and the support plate 105.

Along the insertion opening 13, the cassette 10 has a plurality of latching means 11 arranged concentrically with respect to the insertion opening. If the cassette, as shown in FIG. 3, is placed entirely onto the stepped bolt 20, then the latching means 11 latch into a latching groove 21 of the stepped bolt 20 and lock the fixing system in an operating position.

Figure 4:
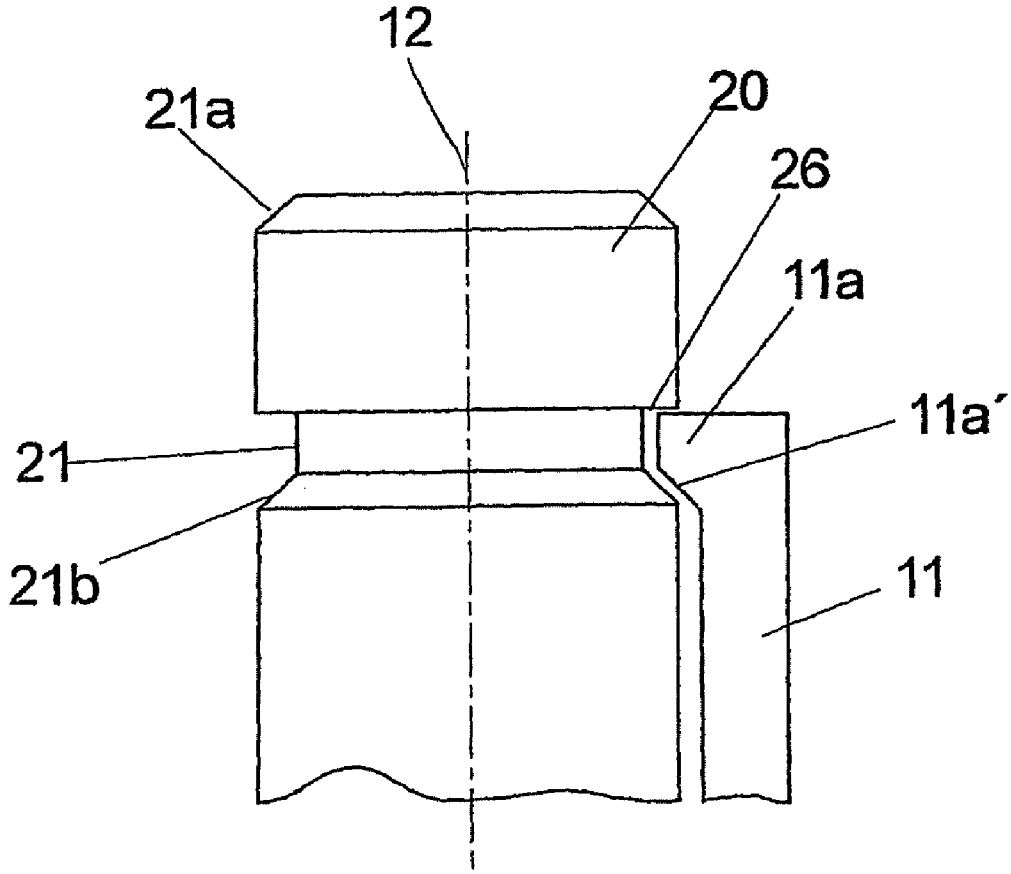
FIG. 4 shows an enlarged illustration of the latching connection between the fixing means and the displacement-force-introducing element of the fixing-means head from FIGS. 2 and 3.

FIG. 4 illustrates this latching mechanism on an enlarged scale. The latching means 11 run essentially along the insertion opening 13 and parallel to a plug-in axis 12 which runs along the insertion direction in the interior of the stepped bolt 20. Said latching means comprise a latching groove 21 and a latching lug 11*a* engaging therein, so that a movement of the fixing means 20 counter to the plug-in direction is prevented by the latching lug 11*a* striking against a shoulder 26 of the head of the stepped bolt 20. In this case, the latching groove 21 runs in a rotationally symmetrical manner around the plug-in axis 12 which is at the same time the cylinder axis of the stepped bolt 20. As a result, a rotational movement of the stepped bolt 20 about the plug-in axis 12 is possible despite the engagement of the latching lug 11*a* in the latching groove 21.

The latching means 11 are designed such that they lead away radially in a resilient manner from the plug-in axis 12. When the stepped bolt 20 is inserted into the insertion opening 13, the oblique surface 21*a* at that end of the stepped bolt 20 which lies opposite the window strikes against an oblique surface 11*a*' on the latching lug 11*a*. Since the two oblique surfaces which strike against each other are oriented parallel to each other, the stepped bolt 20, during its movement in the insertion direction, pushes the resilient latching lugs 11*a* radially outward and thus permits the further insertion of the stepped bolt 20. In this case, the oblique surface 21*a* at that end of the stepped bolt 20 which lies opposite the window is also designed in a rotationally symmetrical manner about the plug-in axis 12.

If the stepped bolt 20 is inserted beyond the latching groove 21 into the cassette, the latching means spring back radially with respect to the plug-in axis 12 and engage in the latching groove 21 in the operating position. On one side of the latching groove 21, the shoulder 26 serves to prevent the stepped bolt 20 from coming out of the insertion opening 13. On the other side, the latching groove 21 has oblique surfaces 21*b* which are designed in a rotationally symmetrical manner with respect to the plug-in axis 12 and correspond to the oblique surfaces 11*a*' of the latching lug 11*a*. An insertion of the stepped bolt 20 beyond the operating position (illustrated in FIG. 4) in the insertion direction is therefore not blocked by the latching lugs 11*a* which, in the process, would be pressed radially outward by the oblique surface 21*b*. This provides the frictional connection between stepped bolt 20 and slider cassette 10 with a movement clearance.

If the fixing system is located in the operating position, when there is a pull on the stepped bolt 20 the latching means 11 introduce pulling-off forces, which are produced counter to the insertion direction, into the cassette 10 and therefore prevent the stepped bolt 20 from being released from the cassette 10.

FIG. 1 shows that the cassette 10 has a total of five latching means 11 which are arranged concentrically with respect to the insertion opening 13. Five bearing ribs 14 against which the stepped bolt 20 bears in the operating position are arranged between the latching means 11. Since the cassette 10 has five latching means 11 and bearing ribs 14 in each case, a mounting which is as stable as possible is produced with the lowest possible number of latching and bearing means. However, a different number of latching means and bearing means can also be used in a fixing system according to the invention, in particular even if the number of bearing means differs from the number of latching means.

The bearing ribs 14 (also illustrated in FIG. 2) run parallel to the stepped bolt 20 along the insertion opening 13. The bearing ribs 14 prevent rotational movements of the stepped bolt 20 relative to the cassette 10 by the bearing ribs 14 bearing against a plurality of contact points of the stepped bolt 20 and fixing it as a result, so that only a rotational movement of the stepped bolt 20 about the plug-in axis 12 is possible. The latching means 11 are arranged within the insertion opening 13 and therefore in a protected position.

A particularly crucial factor in FIG. 2 is a clamping ring 28 which is fixed on the stepped bolt 20 via the slider 102 and is arranged between the slider 102 and the cassette 10. The slider 102 is designed as a multipart slider assembly and, by being attached resiliently to the stepped bolt 20, has a movement clearance which it requires for the guided sliding along the guide rails 100.

If a force is exerted on the stepped bolt 20, then the slider 102 moves along the guide track 100, which partially runs in a curved manner in a plurality of spatial directions, and tilts and rotates with respect to the stepped bolt 20. The clamping ring 28 ensures that these tilting movements are not transmitted to the cassette 10.

Figure 2A:
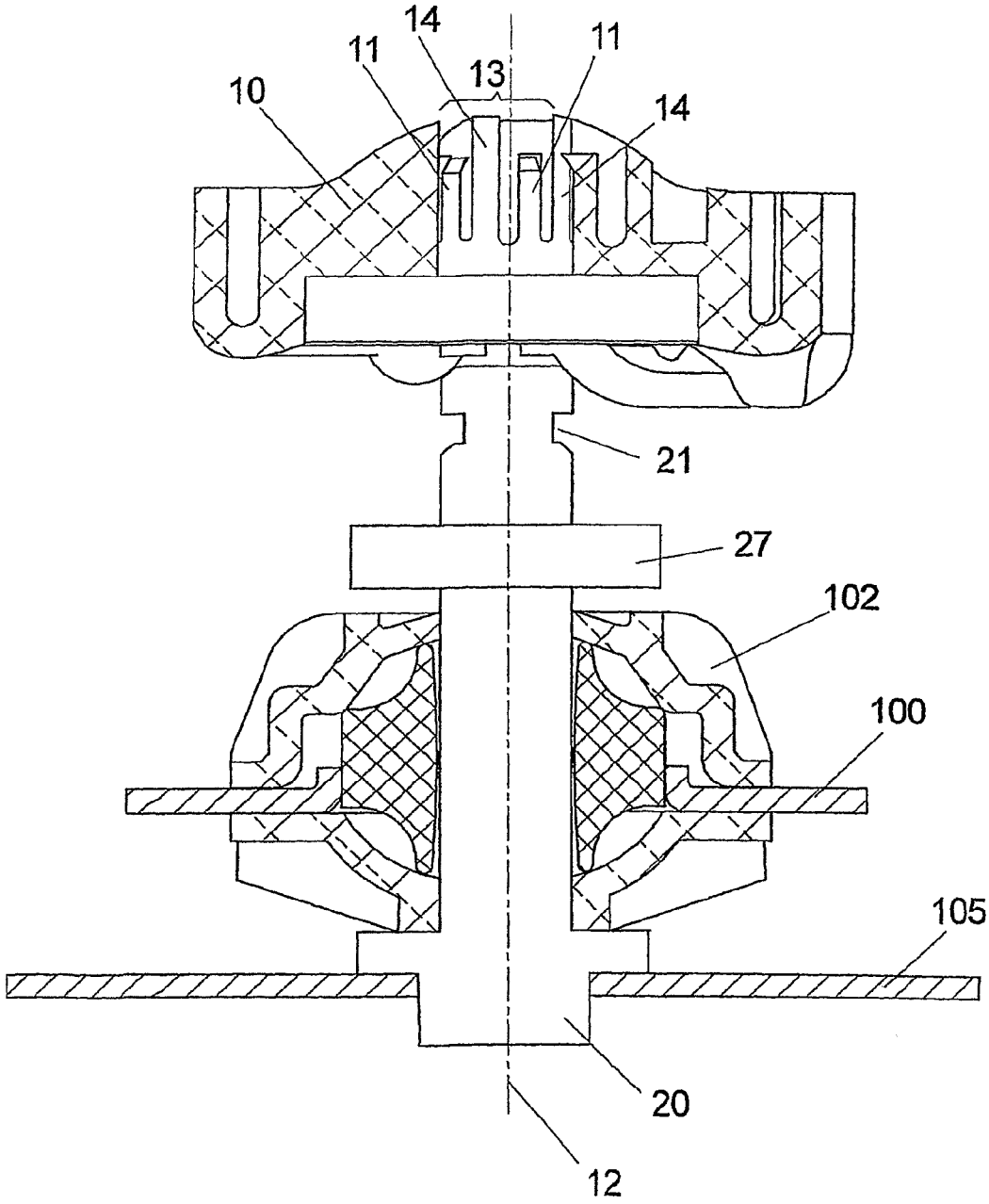
FIG. 2*a* shows a cross-sectional view as in FIG. 2 through view lines B-B of FIG. 1 with a variant of the fixing means.

The fixing system illustrated in FIG. 2*a* is constructed analogously to the fixing system of FIG. 2. The sole difference is that the stepped bolt 20 has a collar 27 which is arranged on the stepped bolt 20 concentrically about the plug-in axis 12. Since the collar 27 has a larger diameter than the insertion opening 13, the striking of the collar 27 against the cassette 10 prevents the stepped bolt 20 from being inserted further than desired into the cassette 10. In addition, the collar 27 takes on the task of the clamping ring 28.

FIG. 1 furthermore shows that the cassette 10 has devices for receiving two cable pulls. A cable pull can be plugged through the cassette 10, through the passage 15*a*, the cable of which is laid along the cable duct 15*b* and is fixed in the nipple chamber 15*c*. The cables and, as a result, also the forces acting on the cassette via the cables then run essentially parallel to the two-part guide rail 100. The tensile force on the cassette, applied via the cable pulls, is transmitted by the frictional connection of the fixing system to the stepped bolt 20. The stepped bolt 20, which likewise penetrates the driver 102, moves the slider 102 along the guide rail 100 and, in addition, the support plate 105 fixed on the stepped bolt 20. The movement of the window therefore takes place together with the movement of the support plate along the guide rail 100.

Figure 5:
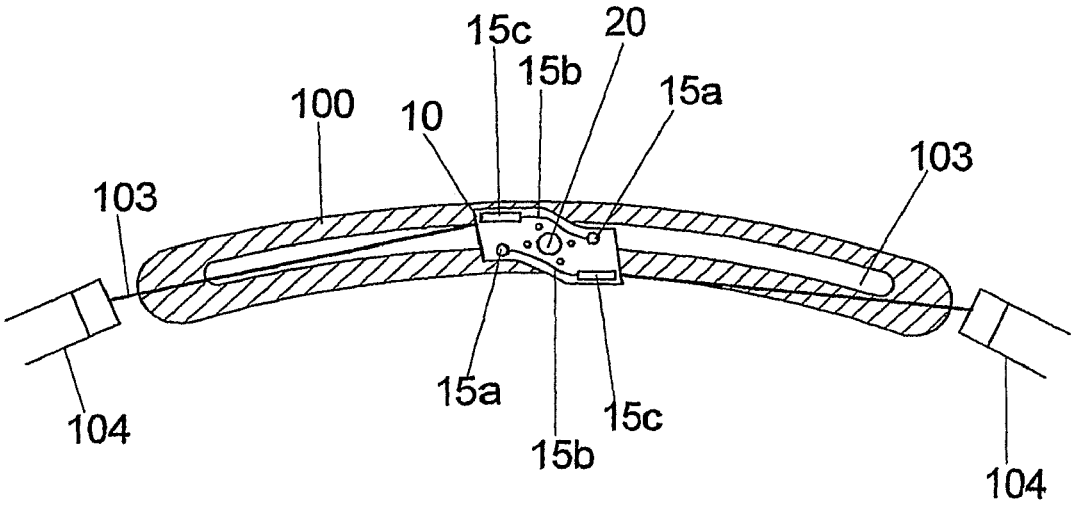
FIG. 5 shows a plan view of a displacement-force-introducing element of a fixing system with cable pulls fitted thereon in a guide rail.

This is further clarified in FIG. 5. The cassette 10 is illustrated here, as in FIG. 1, in a plan view. The cassette 10 is connected to the two cable pulls 103 which are connected to the cassette 10 via the device for receiving cable pulls 15*a*, 15*b*, 15*c*. The cable pulls 103 enter at both of the ends of the guide rail 100 into the guide tubes 104 which stabilize the position of the cable pulls 103 and are connected to a window winder mechanism.

In this embodiment, the guide rail 100 is curved. During the movement of the cassette 10 along the guide rail 100, the cassette 10 has, as seen relative to the two guide tubes 104, a position which is rotated about the stepped bolt 20. A rotation of the cassette 10 about the stepped bolt 20 is also possible in the operating position, since the stepped bolt is of essentially cylindrical or rotationally symmetrical design, in the same manner as its latching groove 21 in which the latching means 11 engage.

The advantages of the fixing system according to the invention reside in particular in that, firstly, the installation is substantially simplified in comparison to the prior art. By plugging the cassette element onto the fixing means, a form-fitting connection is produced which up to now has only been obtained by complicated screwing or riveting of stepped bolts. Secondly, the number of components is reduced by the fixing means, which up to now are of two-part design comprising a stepped bolt with internal thread and screws or stepped bolt and fastening disk, being replaced by one fixing means.

The invention claimed is:

1. A fixing system for fixing a window of a motor vehicle, comprising:

a fixing device comprising a bolt, a slider being movable along a guide track, a displacement-force-introducing element to introduce first displacement forces of a window winder adapted to be engaged to the window, the slider and the displacement-force-introducing element being fitted on the fixing device and the fixing device and the displacement-force-introducing element being operatively connected in an operating position for transmission of said first displacement forces, and a reduction device to reduce a direct transmission of second forces from the slider to the displacement-force-introducing element, wherein the reduction device, in the operating position, is fitted on the fixing device and is arranged between the slider and the displacement-force-introducing element so as to divert said second forces from the slider into the fixing device, and wherein the reduction device is formed integrally with the fixing device as a collar on the fixing device or is fitted on the fixing device as a clamping ring.

2. The fixing system of claim 1, wherein in the operating position, the reduction device completely prevents a direct transmission of said second forces from the slider to the displacement-force-introducing element.

3. The fixing system of claim 1 or 2, wherein the slider and the displacement-force-introducing element are plugged onto the fixing device.

4. The fixing system of claim 1, wherein at least one of the slider and the displacement-force-introducing element is mounted rotatably on the fixing device.

5. The fixing system of claim 1, wherein the slider is arranged on the fixing device and is adapted to be positioned between the window and the displacement-force-introducing element.

6. The fixing system of claim 1, wherein the reduction device is configured in such a manner that the reduction device prevents a direct transmission of force from the slider to the displacement-force-introducing element in an axial direction of the bolt.

7. The fixing system of claim 1, wherein in the operating position, the displacement-force-introducing element is attached to the reduction device.

8. The fixing system of claim 1, wherein the fixing device is configured to be inserted along a plug-in axis into an insertion opening of the displacement-force-introducing element and the reduction device is configured to provide a decoupling of said second forces between the slider and the displacement-force-introducing element in a plug-in direction.

9. The fixing system of claim 1, wherein the fixing device is movable in a guided manner and inserts along a plug-in axis into an insertion opening of the displacement-force-introducing element, and wherein the fixing device is fixed, when inserted into the insertion opening of the displacement-force-introducing element in an operating position, by a latching device of the displacement-force-introducing element, the latching device producing, in the operating position, a latching connection between the fixing device and the displacement-force-introducing element.

10. The fixing system of claim 9, wherein in the operating position, the latching device blocks the fixing device from coming out of the insertion opening of the displacement-force-introducing element.

11. The fixing system of claim 9, wherein the latching device comprises a latching lug to fix the fixing device in the displacement-force-introducing element, and the fixing device comprises a latching groove in which the latching lug engages in the operating position.

12. The fixing system of claim 9, wherein the displacement-force-introducing element comprises a plurality of latching devices formed concentrically with respect to the plug-in axis.

13. The fixing system of claim 9, wherein the displacement-force-introducing element comprises a bearing device which supports the fixing device in the operating position such that the bearing device reduces tilting movements of the displacement-force-introducing element toward the fixing device.

14. The fixing system of claim 13, wherein the bearing device comprises at least one bearing rib which, in the operating position, bears against the fixing device to reduce the tilting movements of the displacement-force-introducing element relative to the fixing device.

15. The fixing system of claim 13, wherein the displacement-force-introducing element comprises a plurality of bearing devices formed concentrically with respect to the plug-in axis.

16. The fixing system of claim 15, wherein the bearing device and latching device are arranged on the displacement-force-introducing element displaced with respect to each other about the plug-in axis in an alternating manner around the plug-in axis.

17. The fixing system of claim 13, wherein the bearing device comprises a helical bearing.

18. The fixing system of claim 9, wherein the displacement-force-introducing element and the latching device are composed of a same material and are formed in one piece.

19. The fixing system of claim 9, wherein the latching device is formed below a surface of the displacement-force-introducing element.

20. The fixing system of claim 19, wherein the reduction device is configured as a collar on the fixing device and has a larger diameter than the insertion opening of the displacement-force-introducing element.

21. The fixing system of claim 1, wherein the displacement-force-introducing element comprises a device for fitting of at least one transmission device, wherein the device is configured to transmit said first displacement forces to the displacement-force-introducing element.

22. The fixing system of claim 1, wherein the fixing device is essentially cylindrical and the plug-in axis coincides with a cylinder axis of the fixing device.

23. A window winder comprising a guide track, a force-introducing device, and a fixing system, the fixing system comprising:

a fixing device to fix a window of a motor vehicle, a slider being arranged on the guide track, a displacement-force-introducing element to introduce first displacement forces of the window winder adapted to engage to the window, the slider and the displacement-force-introducing element being fitted on the fixing device and the fixing device and the displacement-force-introducing element being operatively connected in an operating position for transmission of first displacement forces, and a reduction device to reduce a direct transmission of second forces from the slider to the displacement-force-introducing element, wherein the reduction device, in the operating position, is fitted on the fixing device and is arranged between the slider and the displacement-force-introducing element so as to divert said second forces from the slider into the fixing device, wherein the reduction device is formed integrally with the fixing device as a collar on the fixing device or is fitted on the fixing device as a clamping ring, and wherein the displacement-force-introducing element together with the slider provides a driver of the window winder and the force-introducing device to transmit said first displacement forces is connected to the displacement-force-introducing element.

* * * * *